US005184408A

United States Patent [19]

Kotitschke et al.

[11] Patent Number: 5,184,408

[45] Date of Patent: Feb. 9, 1993

[54] DRYER SECTION

[75] Inventors: Gerhard Kotitschke, Steinheim; Georg Kugler, Heidenheim, both of Fed. Rep. of Germany

[73] Assignee: J. M. Voith GmbH, Fed. Rep. of Germany

[21] Appl. No.: 467,788

[22] Filed: Jan. 19, 1990

[51] Int. Cl.[5] ..... F26B 13/16

[52] U.S. Cl. ..... 34/117; 34/115

[58] Field of Search ..... 34/117, 120, 116, 123, 34/113, 115

[56] References Cited

U.S. PATENT DOCUMENTS 2,537,129 1/1951 Goodwillie .
2,696,149 12/1954 Hornbostel .
2,892,263 6/1959 Hornbostel ..... 34/120
2,959,222 11/1960 Hornbostel ..... 34/117
3,868,780 3/1975 Soininen et al. .
4,359,827 11/1982 Thomas .
4,625,430 12/1986 Aula et al. .
4,905,379 3/1990 Wedel .
4,934,067 6/1990 Wedel ..... 34/117
4,972,608 11/1990 Ilvespaa .

FOREIGN PATENT DOCUMENTS

WO8804206 6/1988 PCT Int'l Appl. .

OTHER PUBLICATIONS

BNA Patent, Trademark and Copyright Journal, Nov. 13, 1986, p. 43.

*Primary Examiner*—Henry A. Bennet
*Attorney, Agent, or Firm*—Ostrolenk, Faber, Gerb & Soffen

[57] ABSTRACT

A dryer section with two dryer groups and a transfer for the paper web between the dryer groups. The receiving dryer group has a vacuum roll on which the felt of the proceeding dryer group is partially wrapped. An adjusting mechanism enables the wrap angle to be adjusted between an arc angle of 0 and 20 degrees.

1 Claim, 1 Drawing Sheet

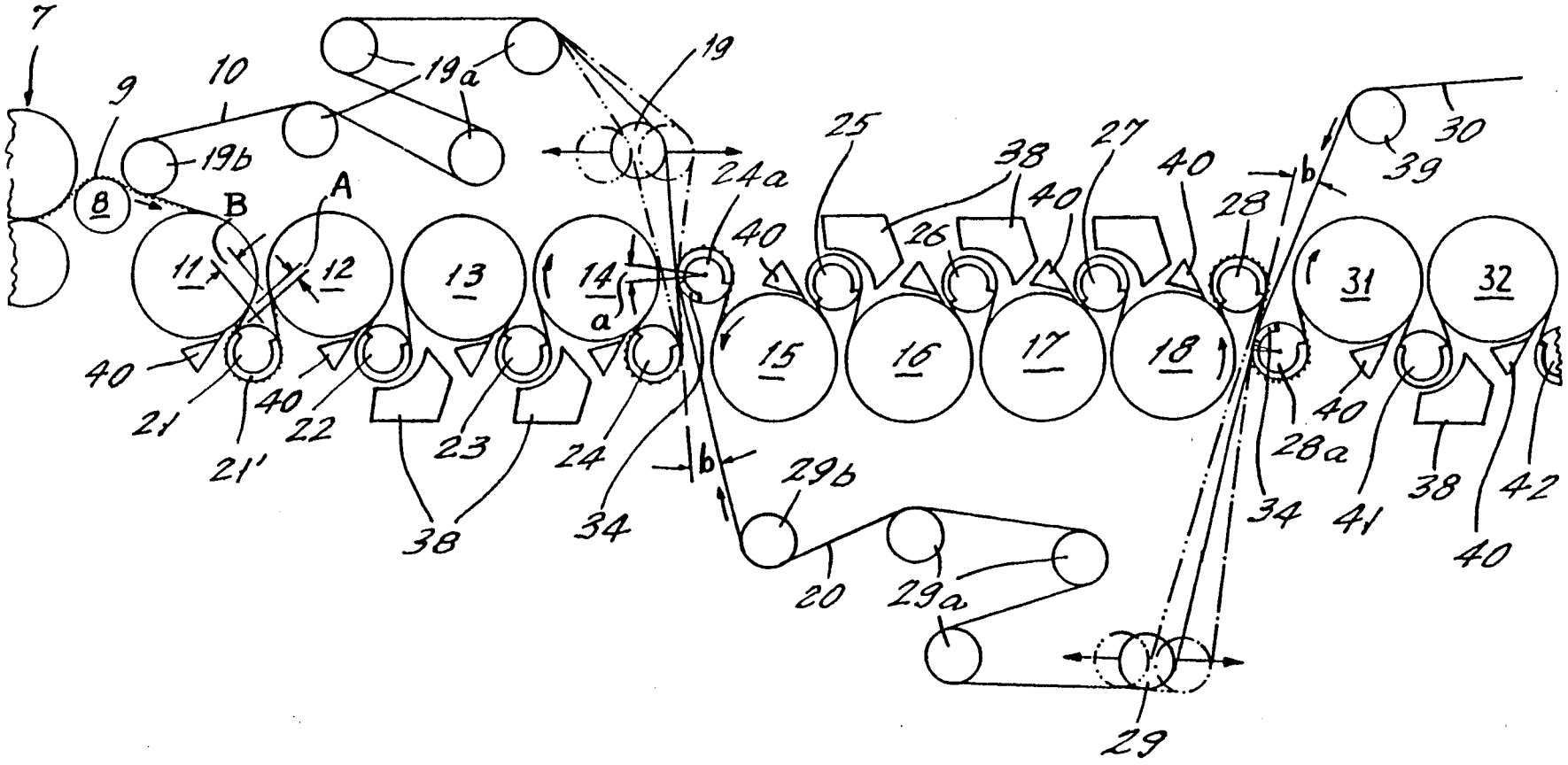
7
8
9
10
11
12
13
14
15
16
17
18
19
19a
19b
20
21
21'
22
23
24
24a
25
26
27
28
28a
29
29a
29b
30
31
32
34
38
39
40
41
42
A
B
a
b

DRYER SECTION

In FIG. 3 of U.S. patent application Ser. No. 321,761, a dryer section is disclosed comprising the features (a) to (e) of the enclosed claim 1. The purpose of such a dryer section is to dry a fiber web, in particular within a paper-making machine having a very high operating speed. The maximum operating speed may be about 1,500 m/min or even higher.

Critical points of such a dryer section are:

1. The area where the fiber web is transferred from one dryer group to the next dryer group.
2. The so-called departure points where the fiber web and the support belt depart from the drying cylinders.

In the above-mentioned FIG. 3, for transferring the web from a first to a second dryer group, a first suction roll of the second dryer group has the function of a pick-up roll (75). The support belt (70) of the first dryer group travels around a last suction roll (74) and then tangentially to the periphery of the pick-up roll (75) around which the support belt of the second dryer group travels Upstream of pick-up roll (75), the two support belts (70 and 80) are forming a so-called convergence angle which may be, e.g. between 3 and 30°.

This configuration disclosed in FIG. 3 is preferred to that of FIG. 1 of the same U.S. application. In FIG. 1, the pick-up roll is designated (24*a*) upstream of which the two support belts are traveling parallel (from roll 24 to roll 24*a*). In this configuration the fiber web may be subjected to stress, if the two support belts must travel at a certain differential speed.

The high operating speed mentioned above is obtainable, among others, due to the suction rolls since the fiber web is held by suction against the support belt when it travels over the suction rolls, against the centrifugal force exerted on the fiber web. In the area, where the fiber web and the support belt are traveling from the periphery of the so-called delivering drying cylinder onto the periphery of the following suction roll, the fiber web should also be safely held against the support belt. To accomplish this goal, it is known from international publication WO 83/00514, FIG. 2, to provide a very short distance between the periphery of the suction roll and the peripheries of the adjacent drying cylinders. However, a problem may arise from the fact that the suction roll is positioned symmetrically with respect to the two adjacent drying cylinders: in some cases, an air blow box may be arranged on the periphery of the suction roll, preferably covering only the second half of the zone looped by the support belt (as disclosed in FIG. 3 of the above-mentioned U.S. application). This may result in an unfavorable small distance between the air blow box and the periphery of the adjacent drying cylinder.

It is a general object of the invention to improve the runability of the dryer section (allowing an extremely high operating speed and avoiding web breaks) while maintaining a high drying efficiency.

It is a further object of the invention to improve the function of the pick-up roll such that the fiber web is safely transferred from one dryer group to the next, permitting a very high operating speed and avoiding any stress subjected to the fiber web. To accomplish this, according to a first aspect of the invention, the second support belt comes into contact with the first support belt only within a small portion of the periphery of the pick-up roll. In other words, a small portion of the periphery of the pick-up roll is wrapped by the support belt of the first dryer group (see claim 1). Preferably, the angle of this periphery portion is selectable during operation of the machine.

It is a further object of the invention to provide a configuration which guarantees holding the fiber web against the support belt when it travels from one of the drying cylinders to the following suction roll while an air blow box may be arranged on the periphery of the suction roll, preferably in the second half of the zone wrapped by the support belt and/or while a certain space should be maintained where vapor escapes from the web before the web comes into contact with the next cylinder. This is accomplished, according to a second aspect of the invention, by the features mentioned in claim 5.

BRIEF DESCRIPTION OF THE DRAWINGS

The Figure is a schematic side elevation of a drying apparatus or "dryer section" of which three drying groups are shown.

DESCRIPTION OF THE PREFERRED EMBODIMENT

The drying apparatus illustrated is part of a paper making machine. The paper web 9 to be dried (partly shown in a dotted line), in the illustrated embodiment, runs through the drying apparatus from left to right. A first drying group comprises four upper, heatable drying cylinders 11 through 14 and four lower felt rolls designed as suction rolls 21 through 24.

A paper support roll 8 transfers the paper web 9 from a press section 7 to a first endless backing belt 10 or "support belt", which preferably is fashioned as a porous wire belt ("dryer fabric") and which travels over a first belt roll 19*b*; this may be a suction roll if required. Together with the backing belt 10, the paper web 9 meanders through the drying group, i.e., alternately over the drying cylinders 11 through 14 and over the suction rolls 21 through 24. From the last suction roll 24, the backing belt 10 runs over several normal belt rolls 19 and 19*a* back to the first belt roll 19*b*. At the departure point from each drying cylinder 11–14, there is a very short distance A (about 30 to 100 mm) between the peripheries of the cylinder and the adjacent suction guide roll. This prevents the web 9 from sticking at the cylinder surface; the web rather follows the support belt 10, under the influence of the suction gland (e.g. 21') of the suction roll. The latter may have a conventional stationary inner suction box or an outer suction box as disclosed in U.S. Pat. No. 4,202,113. Web stabilizers as shown in U.S. application No. 321,761 are no more necessary.

The second drying group comprises four lower heatable drying cylinders 15 through 18 and five upper suction rolls 24*a* and 25 through 28. Passing through this drying group is a second backing belt 20, which from the last suction roll 28 runs over several belt rolls 29, 29*a* and 29*b* back to the first suction roll 24*a*. This latter suction roll 24*a* (or "pick-up roll") picks the paper web up from the backing belt 10, thereby avoiding an open web draw. At the end of this second drying group, i.e., downstream of the last suction roll 28, the paper web 9 is transferred by a further pick-up roll 28*a* to the next drying group; again an open web draw is avoided. Visible of that third group are only two drying cylinders 31 and 32, a backing belt 30, suction rolls 41, 42 and a belt roll 39. In the first dryer group, the underside or "first side" of web 9 contacts the drying cylinders 11–14. In the second dryer group, the upperside or "second side" of web 9 contacts the drying cylinders 15–18. In the third dryer group, the first web side again contacts the cylinders 31, 32.

The belt roll 19 (following to the last suction roll 24 of the first dryer group) is shiftable approximately horizontally. This roll is shown in three different positions: In full lines, it is in its normal position wherein the draw of belt 10 from roll 24 to roll 19 is straight and tangent to the periphery of pick-up roll 24*a*. In this position, the second belt 20 comes into contact with the first belt 10 approximately only at a "point" as seen in the drawing. A further possible position of belt roll 19 is shown in dot-dash-lines, wherein the second belt 20 comes into contact with the first belt 10 within a small portion of the periphery of pick-up roll 24*a*, said portion comprising an angle a of about 10°. This angle a may be varied between zero and at most 20° by shifting of belt roll 19. Thus, the operator is able to select any size of angle a according to the actual requirements, with the angle a depending from the type of the web to be dried or from the operating speed or from the amount of a speed difference sometimes needed between the two belts 10 and 20. In this way, the transfer of web 9 from the first to the second dryer group can be achieved safely even with the highest operating speeds, without the risk of web breaks. Furthermore, the threading of the so-called transfer strip (a narrow edge strip of the web) into the dryer section (e.g. after a shut down) may be accomplished automatically without the assistance of a so-called rope carrier system.

It should be noted that—irrespective of the size of angle a—the two belts 10 and 20, where travelling towards pick-up roll 24*a* are forming a wedge-like gap including a so-called convergence angle b. The size of this angle may be freely selected between about 3° and 30°, according to space conditions.

If the second support belt 20, travelling from belt roll 29*b* to pick-up roll 24*a*, transports air boundary layers which tend to impair the web transfer it is helpful to provide a prolonged suction gland 34 or a separate pre-suction zone in pick-up roll 24*a* at the side where belt 20 is running towards pick-up roll 24*a*.

For some reasons (e.g. one of the dryer groups must be shut down while the others are running) it may be helpful to provide temporarily a distance between the two belts 10, 20 at pick-up roll 24*a*. In this case, roll 19 may be shifted into the position shown with twin-dot-dash lines.

As convention, a doctor 40 is installed at the free surface of each drying cylinder. Furthermore, at some of the suction rolls 22–27 and 41, an air blow box 38 may be provided which may include a suction chamber (not shown) for the removal of moist air. Each of the blow boxes 38 envelopes the pertaining suction roll over approximately one-fourth of its periphery, namely in the second half of the zone looped by the support belt 10 or 20 or 30. For this reason, in the first and in the second dryer group, each of the suction rolls 21–27 is positioned asymmetrically with respect to the two associated drying cylinders, those three rolls forming a set comprising a "web delivering cylinder" (e.g. 12), the suction roll 22 and a "web receiving cylinder" 13. Now, while maintaining the very small distance A, mentioned above, between the peripheries of the web delivering cylinder and the suction roll, there is a larger distance B (about 2 to 10 times larger) between the peripheries of the suction roll and the web receiving cylinder. In this way, space is obtained for said doctor 40, the air blow box 38 and a relatively large gap needed therebetween as well as a gap needed between the air blow box and the web receiving cylinder. Furthermore, where web and support belt are running from the suction roll to the receiving cylinder, space is maintained where vapor escapes from the web, irrespective whether a blow box is present or not.

After the web has received a certain dryness, e.g. at the end of the second dryer group, the tendency that the web sticks to the cylinder surface may be less than before. Therefore, e.g. beginning in the third dryer group, the distance between the web delivering side of each cylinder and the following suction roll may be larger than before In other words: It may be possible then, to arrange each suction roll symmetrically with respect to the two associated cylinders as shown at 31, 32, 41.

In the dryer section shown, all drying cylinders are arranged in horizontal cylinder rows. However, the principles of the invention may also be employed in a dryer section having vertical cylinder rows, as disclosed in pending U.S. application Ser. No. 07/442,547.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

We claim:

1. A dryer section of a machine for manufacturing fiber webs, wherein:

(a) the dryer section comprises a plurality of heatable drying cylinders arranged to form at least a first dryer group and a second dryer group, and arranged in horizontal cylinder rows, and including at least one suction roll allocated to each drying cylinder;

(b) a first and a second endless support belt, each dryer group has a respective one of the first and second endless support belt for supporting the fiber web, with the support belt and the fiber web traveling alternately over the drying cylinders and over the suction rolls so that the fiber web comes into direct contact with the drying cylinders and the support belt comes into direct contact with the suction rolls;

(c) in the first dryer group a first side of the web contacts the drying cylinders, and a second side of the web contacts the support belt;

(d) in the second dryer group, following the first dryer group, the second side of the web contacts the drying cylinders, and the first side of the web contacts the support belt;

(e) within each said second dryer group, at an upstream end thereof, one of the suction rolls is arranged to assume the function of a pick-up roll for transferring the fiber web from the first to the second dryer group such that the second support belt is capable of contacting the first support belt only at a portion comprising an arc angle "a" of the periphery of said pick-up roll, the first and second support belts extending to converge toward each other and to form a wedge-like gap at said pick-up roll of a predetermined angle; and (f) adjusting means for adjusting the size of the arc angle "a" between zero and 20°, said adjusting means comprising a belt roll, leading the first support belt and position downstream of said pick-up roll, said belt roll being shiftable to adjust the size of the arc angle "a", said pick-up roll having a prolonged suction zone or a separate pre-suction zone at the side where the associated support belt is received to suction off air layers carried into said wedge-like gap by said belts.

* * * * *